US011559876B2

(12) United States Patent
Po

(10) Patent No.: US 11,559,876 B2
(45) Date of Patent: Jan. 24, 2023

(54) ELECTRIC NAIL GUN

(71) Applicant: BASSO INDUSTRY CORP., Taichung (TW)

(72) Inventor: Chien-Kuo Po, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 206 days.

(21) Appl. No.: 16/807,398

(22) Filed: Mar. 3, 2020

(65) Prior Publication Data

US 2020/0282534 A1 Sep. 10, 2020

(30) Foreign Application Priority Data

Mar. 6, 2019 (TW) ..... 108107444

(51) Int. Cl.
*B25C 1/04* (2006.01)
*B25C 1/06* (2006.01)
*B25C 1/00* (2006.01)

(52) U.S. Cl.
CPC ..... *B25C 1/047* (2013.01); *B25C 1/008* (2013.01); *B25C 1/06* (2013.01)

(58) Field of Classification Search
CPC ..... B25C 1/04; B25C 1/043; B25C 1/047; B25C 1/06; B25C 1/008
See application file for complete search history.

(56) References Cited

U.S. PATENT DOCUMENTS

| | | | | |
|---|---|---|---|---|
| 8,011,547 | B2 | 9/2011 | Leimbach et al. | |
| 2014/0158740 | A1* | 6/2014 | Akutsu | B25C 1/046 227/130 |
| 2019/0134795 | A1* | 5/2019 | Bauer | B25C 1/043 |
| 2019/0168366 | A1* | 6/2019 | Yasutomi | B25C 1/047 |
| 2019/0344415 | A1* | 11/2019 | Furumi | B25C 1/043 |

* cited by examiner

*Primary Examiner* — Anna K Kinsaul
*Assistant Examiner* — Veronica Martin

(57) ABSTRACT

An electric nail gun includes a muzzle seat, a safety component being movable relative to the muzzle seat, and a cylinder unit connected to the muzzle seat and including a striking cylinder, at least one storage chamber that is adapted for storing pressurized air, and a sealing cap that is coupled to the striking cylinder and the at least one storage chamber. The electric nail gun further includes an air valve disposed in the cylinder unit and being directly and solely movable by the safety component from a closed position to an open position to allow the pressurized air to flow into the striking cylinder, and a nail-striking unit driven movably by the pressurized air for striking a nail when the air valve is at the open position.

9 Claims, 10 Drawing Sheets

ELECTRIC NAIL GUN

CROSS-REFERENCE TO RELATED APPLICATION

This application claims priority of Taiwanese Patent Application No. 108107444, filed on Mar. 6, 2019.

FIELD

The disclosure relates to an electric nail gun, and more particularly to a pneumatic electric nail gun.

BACKGROUND

Referring to FIG. 1, a conventional electric nail gun 1 disclosed in U.S. Pat. No. 8,011,547 includes a machine body 11, a guide member 12, a lifter 13, a gas cylinder 14, a piston 15 and a striking member 16.

The guide member 12 is connected to the machine body 11 and is adapted for loading a nail 2. The lifter 13 is mounted to the machine body 11 and is drivable by electric power to rotate counterclockwise. The gas cylinder 14 is mounted in the machine body 11, and defines a cylinder space 140. The piston 15 is disposed in the cylinder space 140 of the gas cylinder 14, divides the cylinder space 140 into an upper section 141 and a lower section 142, and is movable relative to the machine body 11 such that volumes of the upper and lower sections 141, 142 are variable. The striking member 16 is co-movably connected to the piston 15, and extends through the lower section 142 of the cylinder space 140 into the guide member 12. The striking member 16 has a striking portion 161 that is distal from the piston 15 and that is for striking the nail 2, and a cogged portion 162 that is disengageably engaged with the lifter 13.

When the lifter 13 is powered by electric power to rotate counterclockwise, due to the engagement between the cogged portion 162 and the lifter 13, the striking member 16 and the piston 15 are both driven by the lifter 13 to move upwardly. The upward movement of the piston 15 reduces the volume of the upper section 141 of the cylinder space 140 and pressurizes air therein. As the lifter 13 continues to rotate to a specific orientation, it disengages the striking member 16. The disengagement of the striking member 16 from the lifter 14 prompts the pressurized air in the upper section 141 of the cylinder space 140 to push the piston 15, urging the striking portion 161 of the striking member 16 to strike the nail 2.

By repeating the above-mentioned process, the conventional electric nail gun 1 is able to perform high-speed consecutive nailing cycles since the air in the upper section 141 of the cylinder space 140 is constantly in direct contact with the piston 15, either before or after being pressurized. However, such configuration has its downsides. Without anything functioning as a safeguard or buffering the interaction between the piston 15 and the pressurized air, the striking member 16 may strike the nail 2 by accident if any of the lifter 13 and the striking member 16 malfunctions and breaks the engagement therebetween, causing safety issues for users.

In addition, during each nailing cycle, the pressurized air in the upper section 141 of the cylinder space 140 is released completely after the striking, that is, an output of kinetic energy is not adjustable. Therefore, energy excess may occur when the conventional electric nail gun 1 is used with different types of nail 2 or workpieces, resulting in excessive recoil and impact that may shorten the lifespan of the nail gun.

SUMMARY

Therefore, the object of the disclosure is to provide an electric nail gun that can alleviate at least one of the drawbacks of the prior art.

According to the disclosure, an electric nail gun includes a machine body, a muzzle unit, a cylinder unit, a valve unit and a nail-striking unit.

The muzzle unit includes a muzzle seat and a safety component. The muzzle seat is connected to the machine body and is adapted for loading a nail along an axis. The safety component is mounted movably to the muzzle seat, and has a contact portion adapted for making contact with a workpiece to initiate movement of the safety component relative to the muzzle seat along the axis.

The cylinder unit is disposed in the machine body, and includes a striking cylinder, at least one storage chamber and a sealing cap. The striking cylinder is connected to the muzzle seat, defines a cylinder space that is elongated along the axis, and has an open end. The at least one storage chamber is connected to the striking cylinder, defines an internal space that is adapted for storing pressurized air, and has an open end. The sealing cap is coupled to the striking cylinder and the at least one storage chamber. The open ends of the striking cylinder and the storage chamber cooperate with the sealing cap to define an air space that is in spatial communication with the cylinder space and the internal space.

The valve unit includes an air valve disposed in the air space of the cylinder unit, and being co-movable with directly and solely movable by the safety component along the axis from a closed position, where the air valve is coupled to the open end of the striking cylinder to prohibit the pressurized air stored in the air space from flowing into the cylinder space, to an open position, where the air valve is disposed away from the open end of the striking cylinder to allow the pressurized air stored in the air space to flow into the cylinder space.

The nail-striking unit includes a piston and a striking member. The piston is movably disposed in the cylinder space of the striking cylinder. The striking member is connected co-movably to the piston, and extends along the axis into the muzzle seat.

When the air valve is at the open position, the piston is urged by the pressurized air flowing into the cylinder space to move along the axis, thereby moving the striking member to strike the nail.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
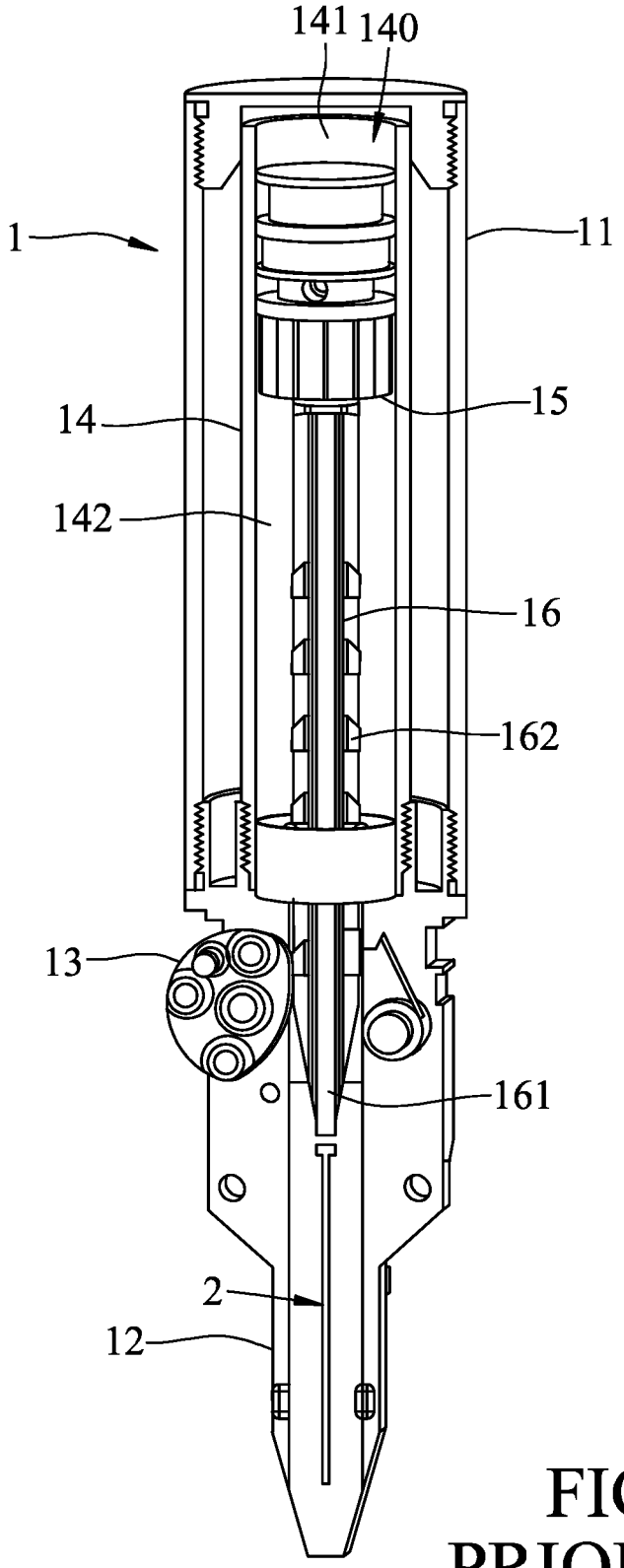
FIG.1 PRIOR ART
FIG. 1 is a fragmentary perspective view in partial cross-section of a conventional electric nail gun disclosed in U.S. Pat. No. 8,011,547.
Figure 2:
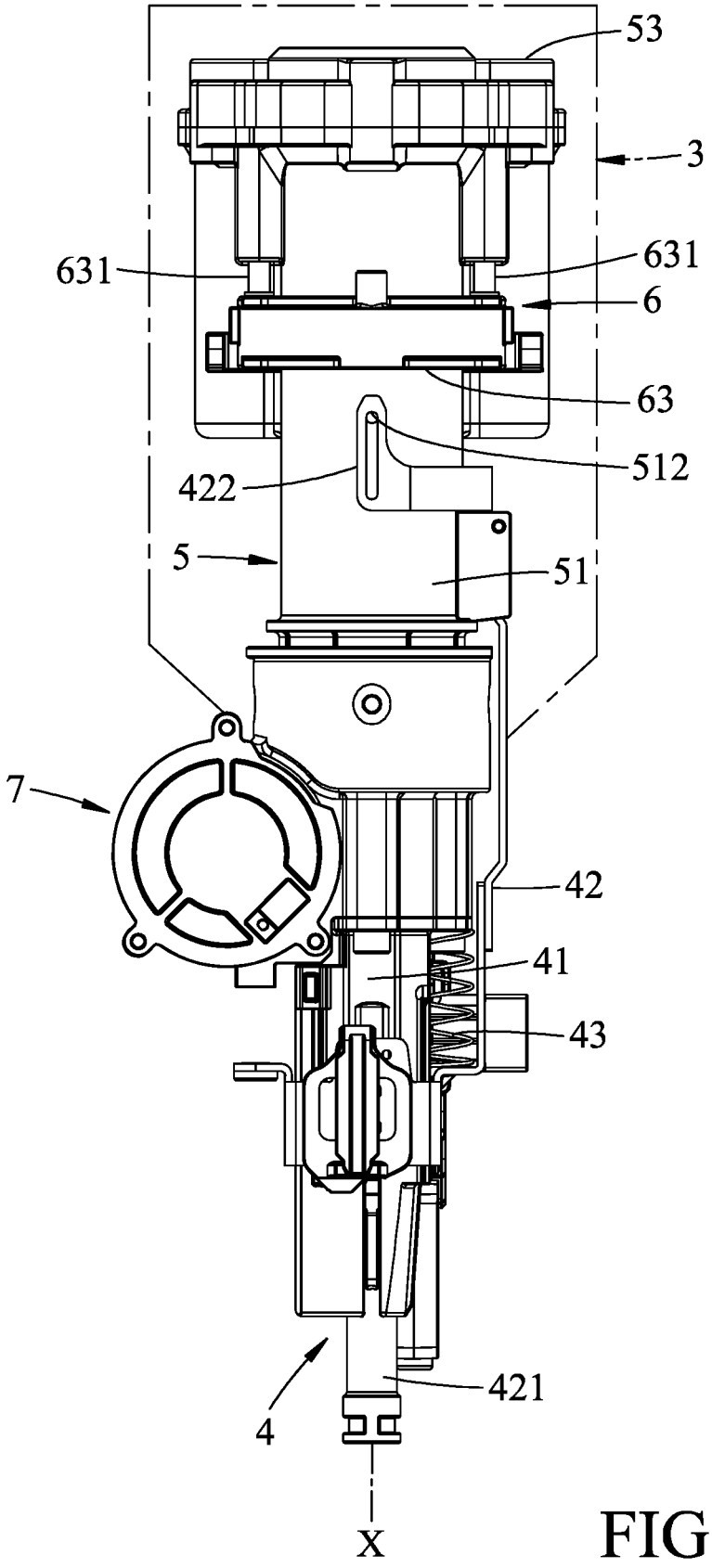
FIG. 2 is a fragmentary side view of an embodiment of an electric nail gun according to the disclosure.
Figure 3:
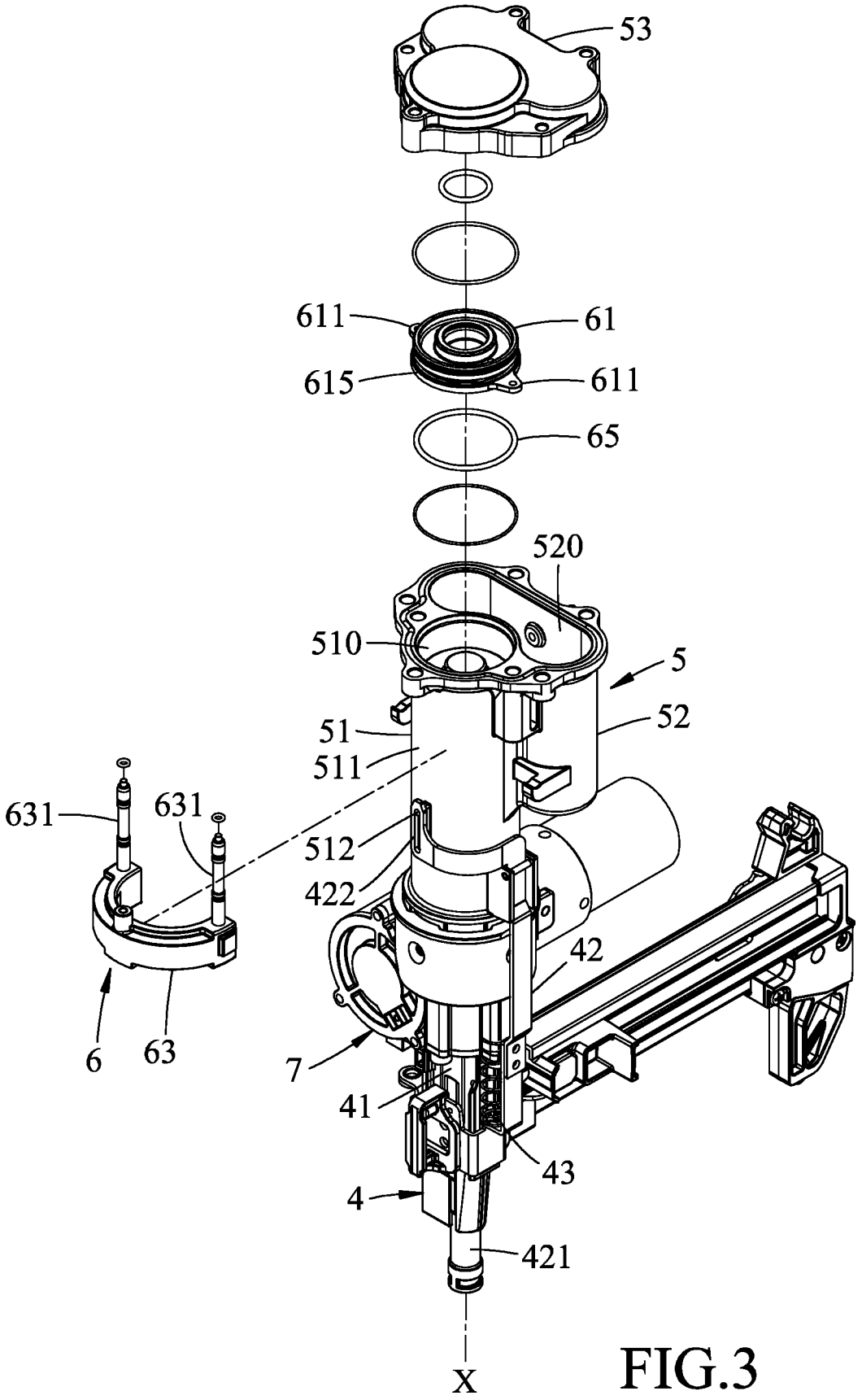
FIG. 3 is a fragmentary and partially exploded perspective view of the embodiment.
Figure 4:
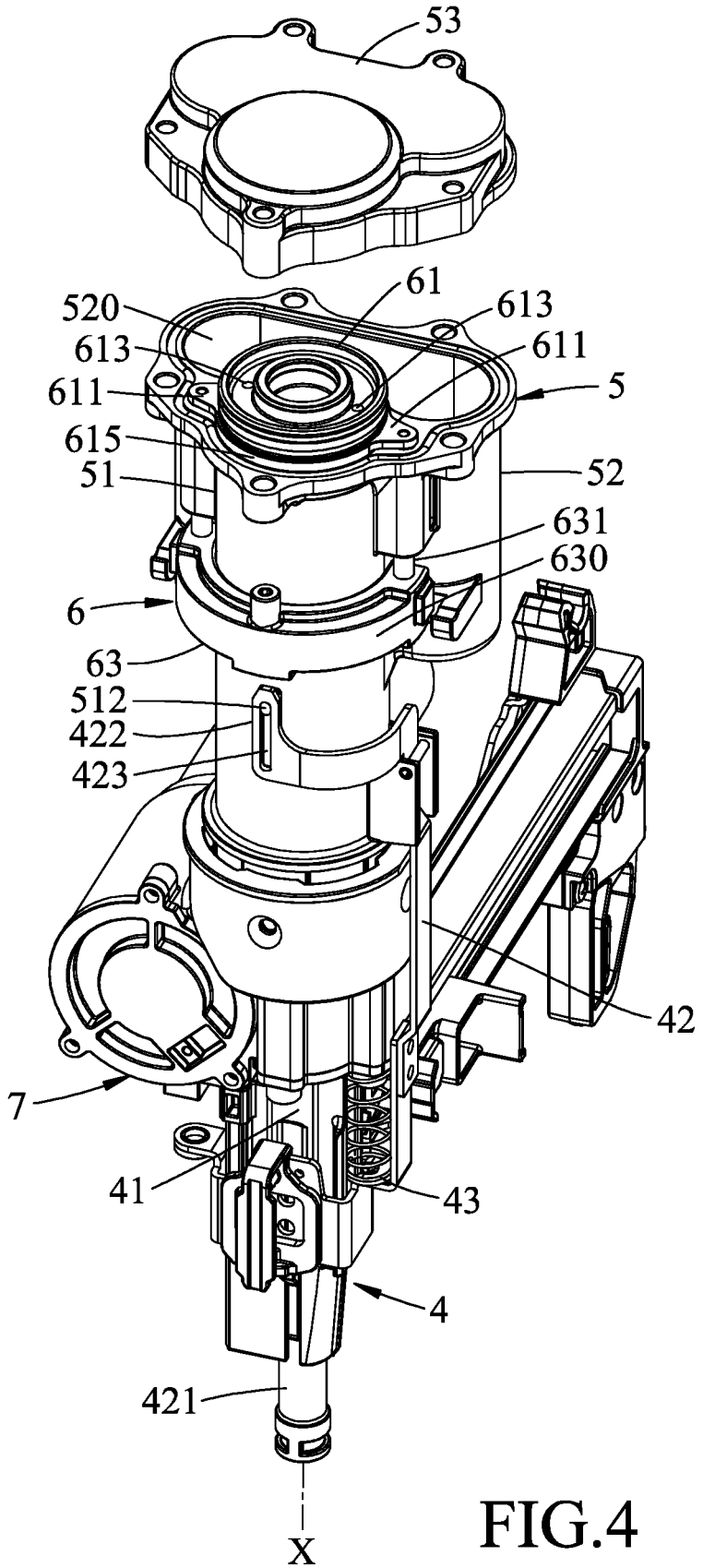
FIG. 4 is another fragmentary and partially exploded perspective view of the embodiment.

Referring to FIGS. 2 to 4, an embodiment of an electric nail gun according to the disclosure includes a machine body 3, a muzzle unit 4, a cylinder unit 5, a valve unit 6 and a nail-striking unit 7.

The muzzle unit 4 includes a muzzle seat 41 and a safety component 42.

The muzzle seat 41 is connected to the machine body 3 and is adapted for loading a nail 8 (see FIG. 5) along an axis (X). The safety component 42 is mounted movably to the muzzle seat 41, and has a contact portion 421 and an extending portion 422. The contact portion 421 of the safety component 42 is adapted for making contact with a workpiece (not shown) to initiate movement of the safety component 42 relative to the muzzle seat 41 along the axis (X). The extending portion 422 of the safety component 42 is opposite to the contact portion 421 along the axis, and is formed with an elongated hole 423 that is elongated in the direction of the axis (X).

Referring to FIGS. 3 to 6, in this embodiment, the cylinder unit 5 is disposed in the machine body 3, and includes a striking cylinder 51, a storage chamber 52 and a sealing cap 53.

The striking cylinder 51 is connected to the muzzle seat 41 of the muzzle unit 4, and includes a cylinder body 511 and a guide protrusion 512.

The cylinder body 511 of the striking cylinder 51 defines a cylinder space 510 that is elongated along the axis (X), and has an open end that is distal from the muzzle seat 41 of the muzzle unit 4. The guide protrusion 512 of the striking cylinder 51 protrudes outwardly from the cylinder body 511 and extends into the elongated hole 423 of the safety component 42 for guiding the movement of the safety component 42 along the axis (X).

The storage chamber 52 is connected to the striking cylinder 51, defines an internal space 520 that is adapted for storing pressurized air, and has an open end that is adjacent to the open end of the striking cylinder 51.

The sealing cap 53 is coupled to the striking cylinder 51 and the storage chamber 52. The open ends of the striking cylinder 51 and the storage chamber 52 cooperate with the sealing cap 53 to define an air space 50 that is in spatial communication with the cylinder space 510 and the internal space 520.

Referring to FIGS. 3 to 7, in this embodiment, the valve unit 6 includes an air valve 61, a connecting component 63 and a unidirectional valve 65.

The connecting component 63 is mounted to the striking cylinder 51 and is movable relative to the striking cylinder 51 along the axis (X). The air valve 61 is disposed in the air space 50 of the cylinder unit 5, cooperates with the sealing cap 53 of the cylinder unit 5 to define a back pressure space 610 that overlaps with the air space 50, and is connected co-movably to the connecting component 63 such that the air valve 61 is movable, due to the movement of the connecting component 63 along the axis (X), between a closed position (see FIGS. 5 and 6) and an open position (see FIGS. 7 to 10).

Specifically, while at the closed position, the air valve 61 is coupled to the open end of the striking cylinder 51 to prohibit the pressurized air stored in the air space 50 and the internal space 520 from flowing into the cylinder space 510; while at the open position, the air valve 61 is disposed away from the open end of the striking cylinder 51 to allow the pressurized air stored in the air space 50 and the internal space 520 to flow into the cylinder space 510.

Moreover, the air valve 61 has a main body 615, two tabs 611, a plurality of air-releasing holes 612, and two back pressure holes 613. The main body 615 is hollow, and has opposite outer and inner surfaces facing respectively the air space 50 and the cylinder space 510 when the air valve 61 is at the closed position. The tabs 611 are connected to the outer surface of the main body 615 and are angularly spaced apart from each other. The air-releasing holes 612 are arranged angularly around the main body 615, and extend through the inner and outer surfaces of the main body 615.

The back pressure holes 613 are disposed between the tabs 611, and extend through the main body 615 in the direction of the axis (X), thereby spatially intercommunicating the back pressure space 610 with the cylinder space 510. Such configuration allows for smooth transition of the air valve 61 from the closed position to the open position, which will be described further later.

The connecting component 63 of the valve unit 6 includes two guide rods 631 and a curved portion 630.

The guide rods 631 of the connecting component 63 are spaced apart from each other, are mounted to the striking cylinder 51, and are movable relative to the striking cylinder 51. Each of the guide rods 631 extends in the direction of the axis (X), and is connected to a respective one of the tabs 611 of the air valve 61.

The curved portion 630 of the connecting component 63 extends circumferentially along an outer surface of the striking cylinder 51, has opposite end portions connected respectively to the guide rods 631, and is in contact with the safety component 42 when the air valve 61 moves from the closed position to the open position, that is, the connecting component 63 interconnects the air valve 61 and the safety component 42 when the air valve 61 moves from the closed position to the open position.

Referring again to FIGS. 5 and 6, the unidirectional valve 65 of the valve unit 6 is mounted to the air valve 61, and openably seals the air-releasing holes 612.

Specifically, in the present embodiment, the unidirectional valve 65 is configured as an O-ring, and surrounds the air valve 61 such that the unidirectional valve 65 openably seals the air-releasing holes 612. When the unidirectional valve 65 is pushed by the pressurized air flowing from the cylinder space 510 into the air-releasing holes 612, the unidirectional valve 65 (i.e. the O-ring) stretches to unseal the air-releasing holes 612.

As shown in FIGS. 2 to 5, the muzzle unit 4 further includes a resilient member 43 that is mounted between the muzzle seat 41 and the safety component 42 for biasing the safety component 42 away from the valve unit 6 along the axis (X).

Referring to FIGS. 4, 5, 9 and 10, the nail-striking unit 7 includes a lifting gear 71, a piston 72, a rack 73 and a striking member 74.

The lifting gear 71 is rotatably mounted to the muzzle seat 41, is rotatable by electric power in a unidirectional manner, and has a periphery formed with a toothed section 711 and an untoothed section 712.

The piston 72 is movably disposed in the cylinder space 510 of the striking cylinder 51, and is in air-tight contact with an inner surface of the striking cylinder 51.

The rack 73 is co-movably connected to the piston 72, and has a cogged portion 731 that extends in the direction of the axis (X). During the unidirectional rotation of the lifting gear 71, the lifting gear 71 disengageably engages the cogged portion 731 of the rack 73.

Specifically, when the lifting gear 71 is engaged with the rack 73, the toothed section 711 of the lifting gear 71 engages the cogged portion 731 of the rack 73; when the lifting gear 71 is disengaged from the rack 73, the toothed section 711 of the lifting gear 71 disengages the cogged portion 731, and the untoothed section 712 of the lifting gear 71 is adjacent to the cogged portion 731.

The striking member 74 is connected co-movably to the piston 72, and extends along the axis (X) into the muzzle seat 41 for striking the nail 8. In the present embodiment, the striking member 74 is removably connected to the piston 72, and is parallel to the rack 73. It should be noted that the cogged portion 731 is not limited to be part of the rack 73; in variations of the embodiment, the electric nail gun may not include the rack 73 and the cogged portion 731 may be formed as part of the striking member 74.

For a further understanding of the embodiment of the disclosure, details of an operation of the electric nail gun is described in the following passages.

Referring to FIGS. 5 to 10, the operation of the electric nail gun includes at least one nailing cycle. At the beginning a nailing cycle, the contact portion 421 of the safety component 42 is not pressed against the workpiece, and the air valve 61 is at the closed position.

When the nailing cycle starts, the lifting gear 71 of the nail-striking unit 7 is driven by the electric power to rotate in a rotary direction (r). The toothed section 711 of the lifting gear 71 engages the cogged portion 731 of the rack 73 such that the rotation of the lifting gear 71 moves the cogged portion 731 of the rack 73, together with and the piston 72, along the axis (X) toward the air valve 61.

Figure 5:
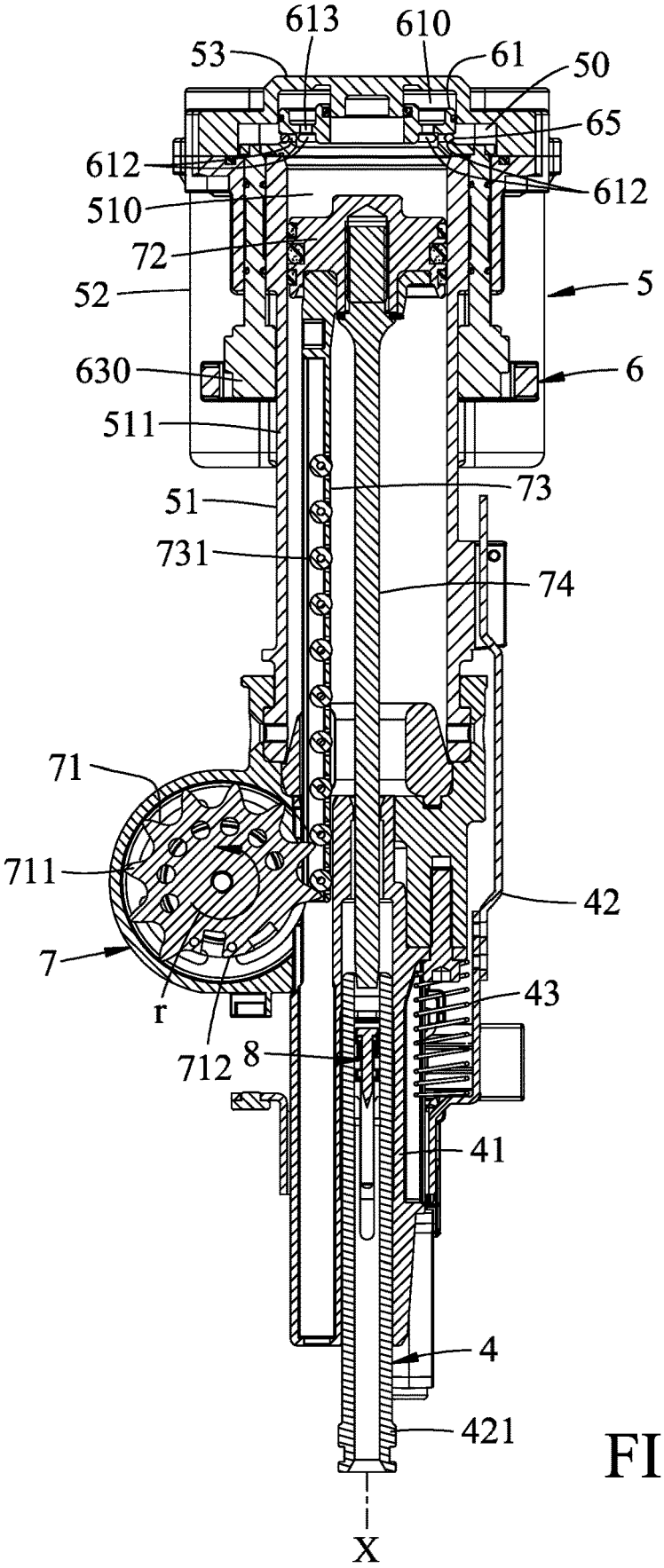
FIG. 5 is a fragmentary sectional view of the embodiment, illustrating an air valve of a valve unit at a closed position.
Figure 6:
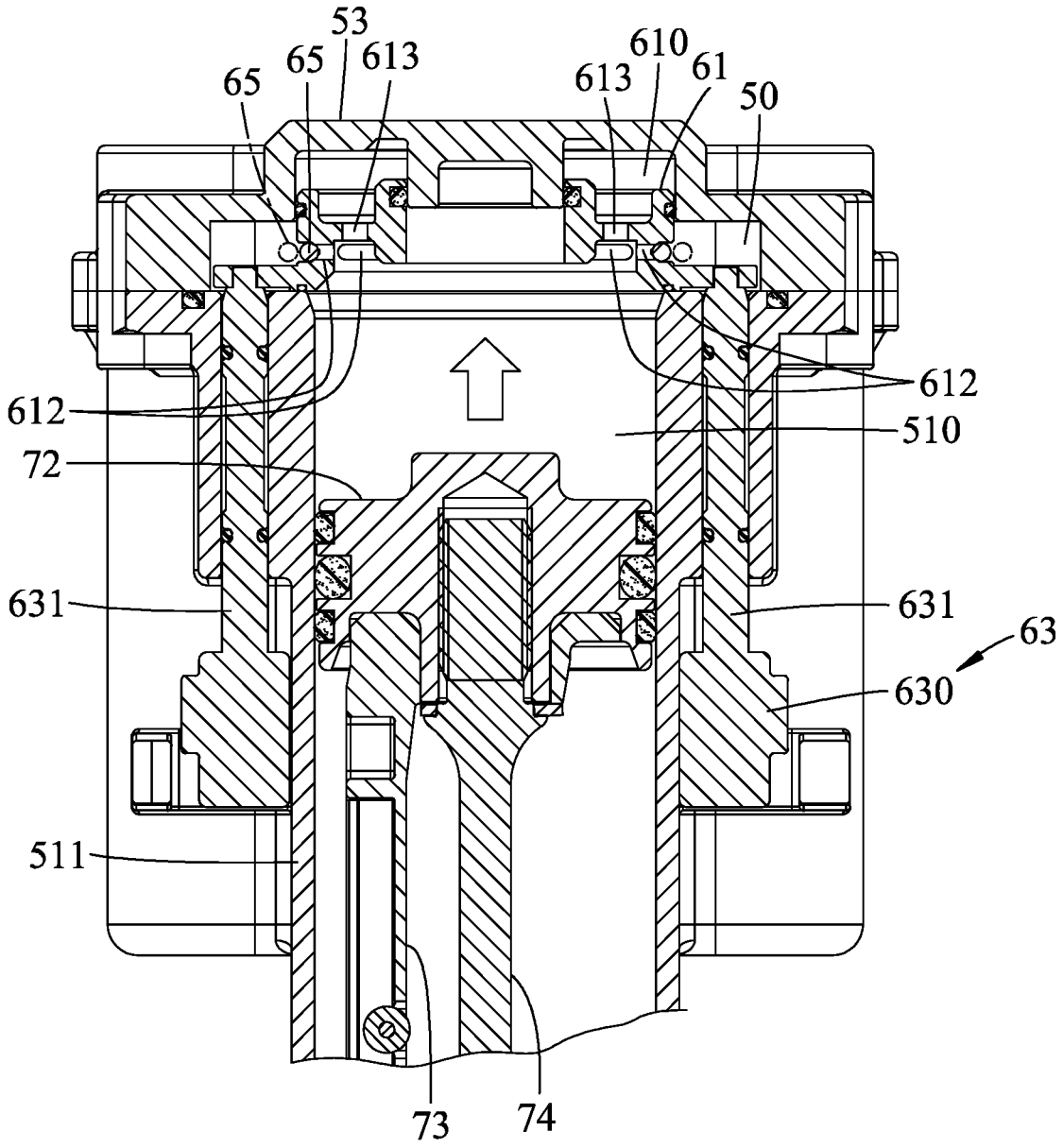
FIG. 6 is an enlarged fragmentary sectional view of the embodiment, illustrating a unidirectional valve of the valve unit being forced to open by pressurized air.
Figure 7:
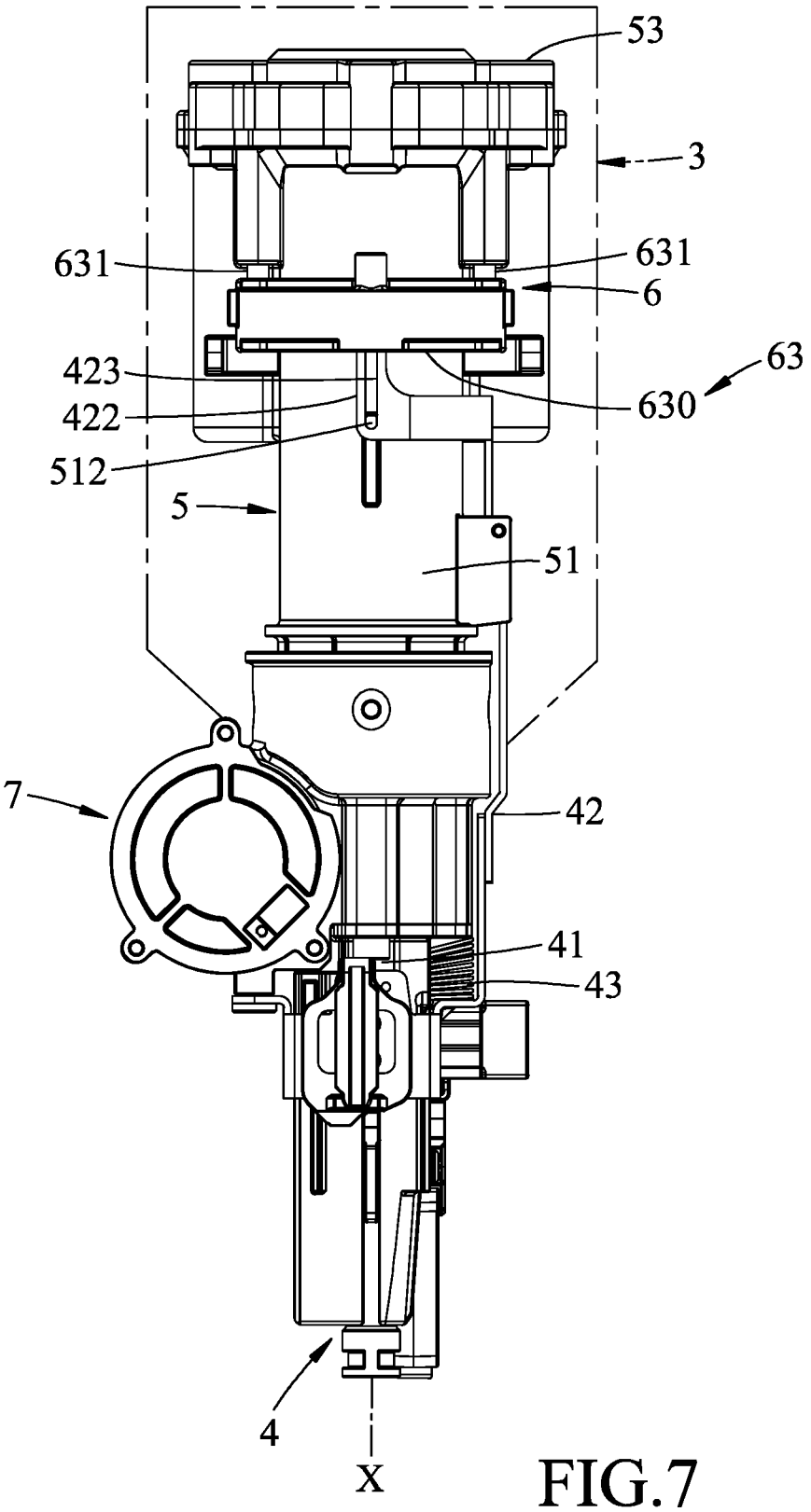
FIG. 7 is another fragmentary side view similar to FIG. 2, illustrating the valve unit being moved by a safety component to an open position.
Figure 8:
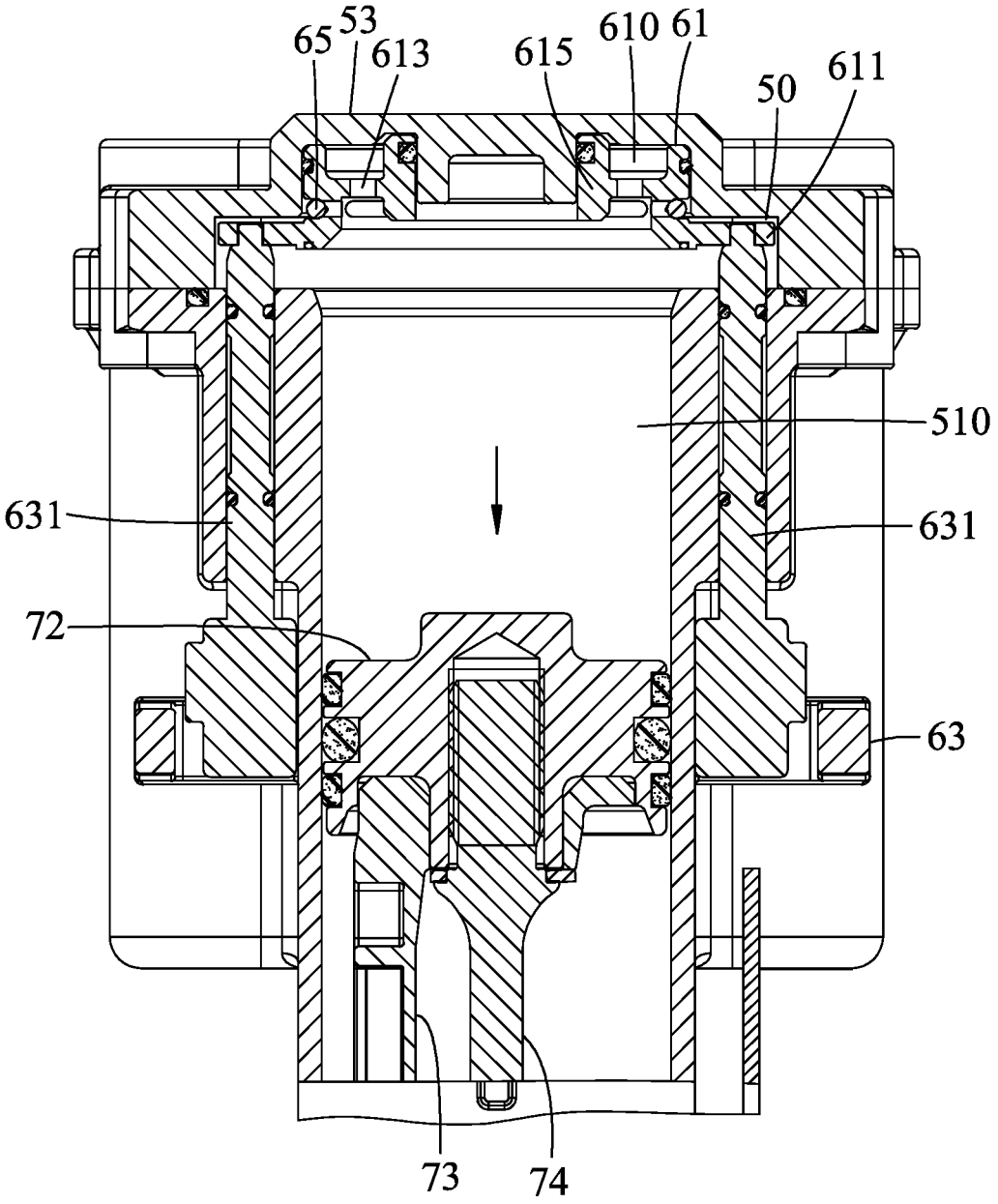
FIG. 8 is another enlarged fragmentary sectional view of the embodiment, illustrating the air valve at the open position.
Figure 9:
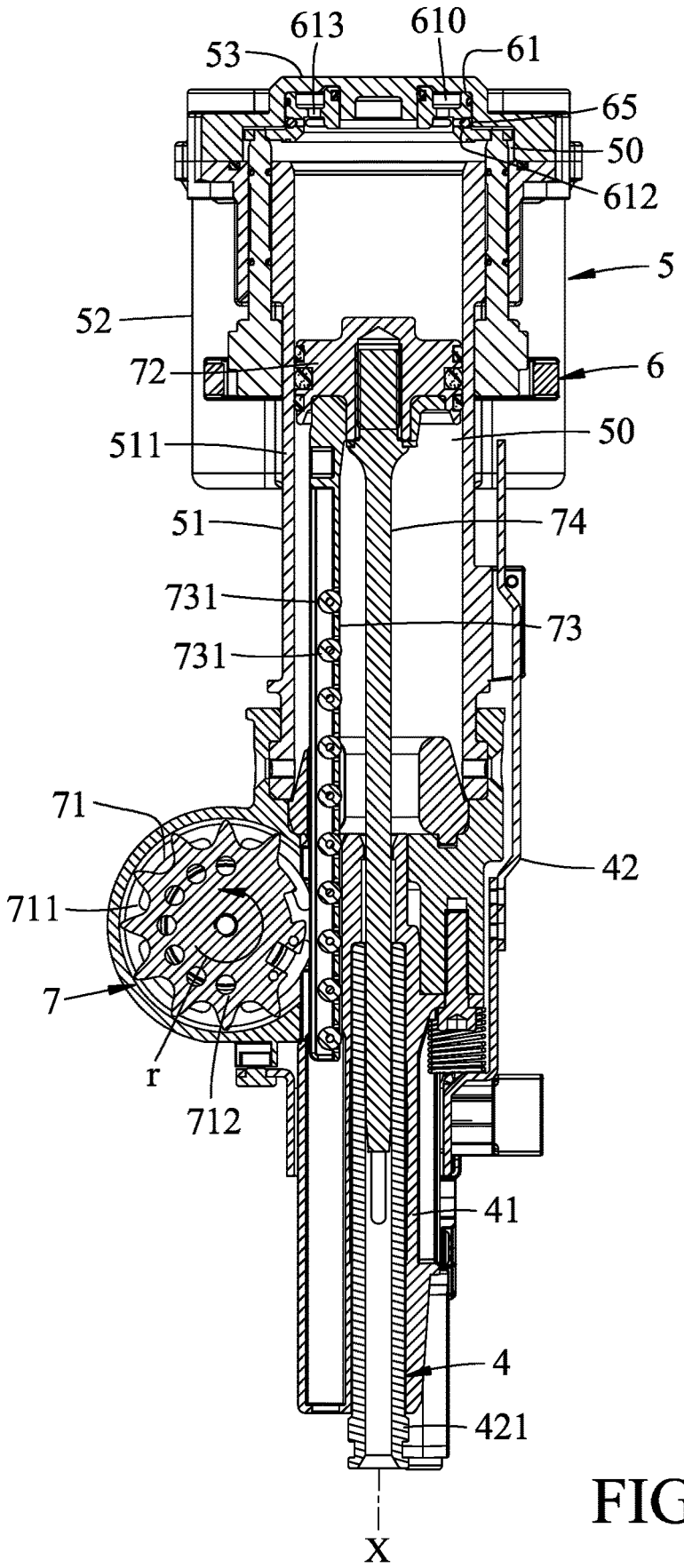
FIGS. 9 and 10 are fragmentary sectional views similar to FIG. 5, illustrating a nail-striking operation of a nail-striking unit when the air valve is at the open position.
Figure 10:
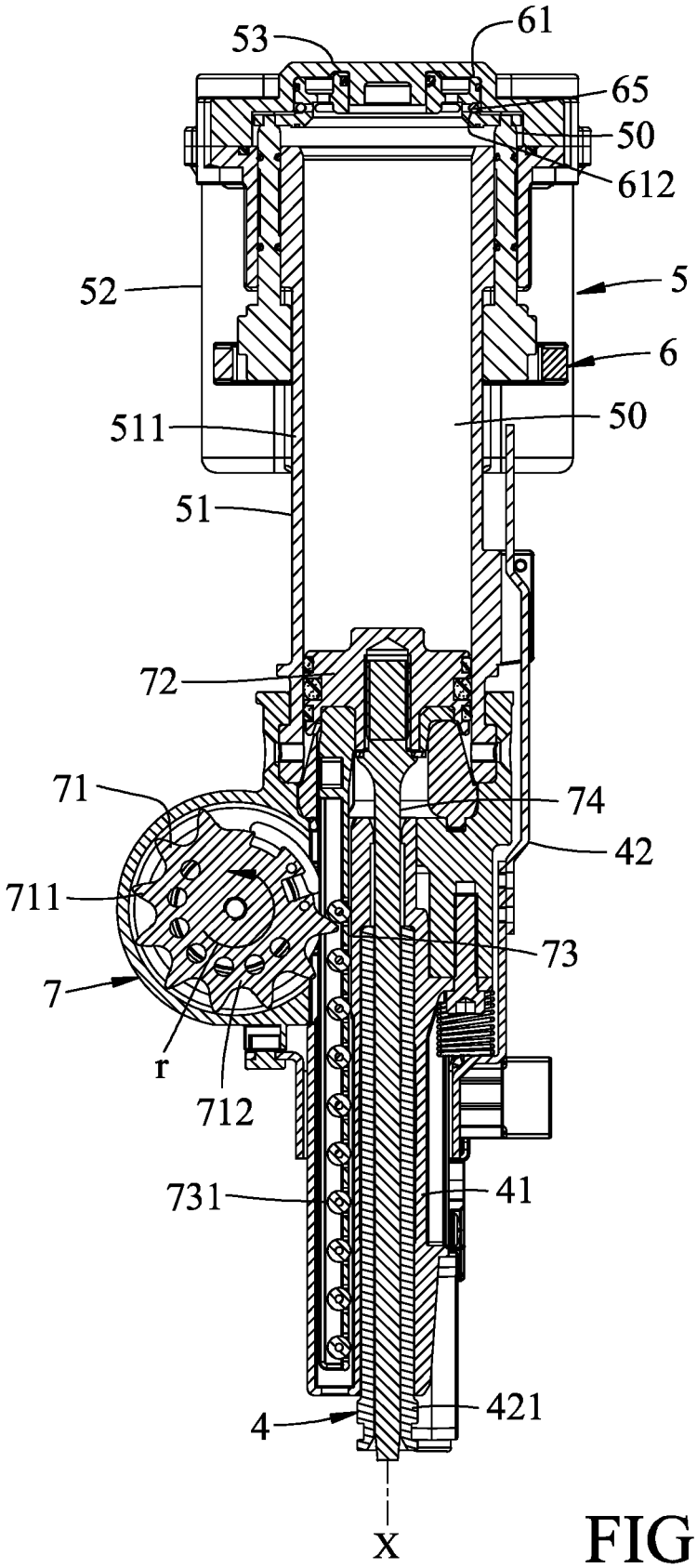

During this time, the movement of the piston 72 toward the air valve 61 pressurizes air in the cylinder space 510, forcing the pressurized air to open the unidirectional valve 65 and to flow into the air space 50 and the internal space 520 via the air-releasing holes 612. When the piston 72 is moved proximate to the air valve 61, as shown in FIG. 5, the air and internal spaces 50, 520 are filled with the pressurized air.

Referring to FIGS. 7 to 10, next, the contact portion 421 of the safety component 42 is pressed against the workpiece such that the safety component 42 is moved toward the cylinder unit 6 relative to the muzzle seat 41, and the resilient member 43 is compressed and exerts a biasing force against the safety component 42.

During this time, the extending portion 422 of the safety component 42 makes contact with the curved portion 630 of the connecting component 63 and forces the connecting component 63 to move therewith, thereby bringing the air valve 61 from the closed position to the open position, and allowing the pressurized air stored in the air space 50 and the internal space 520 to flow into the cylinder space 510.

It should be noted that, as the air valve 61 moves from the closed position to the open position, air disposed in the back pressure space 610 is forced to follow into the cylinder space 510 via the back pressure holes 613, preventing generation of back pressure that hinders the movement of the air valve 61.

It should also be noted that, right before the pressurized air pushes the piston 72 toward the muzzle seat 41, the untoothed section 712 of the lifting gear 71 is adjacent to the cogged portion 731 of the rack 73, that is, the cogged portion 731 is not driven by the lifting gear 71 so that when the piston 72 is pushed by the pressurized air toward the muzzle seat 41, a collective movement of the piston 72, the rack 73 and the striking member 74 is not interfered by the lifting gear 71.

Consequently, as the pressurized air enters the cylinder space 510 and results in the collective movement of the piston 72, the rack 73 and the striking member 74 along the axis (X), the striking member 74 is forced further into the muzzle seat 41 to strike the nail 8. When the striking of the nail 8 is completed and when the contact portion 421 is moved away from the workpiece, the safety component 42 is biased by the resilient member 43 along the axis (X) to be away from the valve unit 6, and the air valve 61 returns to the closed position (generally by a force of air pressure in the air space 50 along the direction of the axis (X)). In variations of the embodiment, a resilient component may be disposed between the air valve 61 and the sealing cap 53 to bias the air valve 61 back to the closed position.

At this point, the nailing cycle is completed and another nailing cycle may be performed by repeating the above-mentioned process.

In sum, the present embodiment according to the disclosure has advantages as follows.

In virtue of configurations of the air valve 61 and the cylinder unit 5, the pressurized air is not allowed to enter the striking cylinder 51 without the safety component 42 being pressed against the workpiece. In other words, when the nail-striking unit 7 malfunctions, the striking member 74 will not strike the nail 8 by accident since the air pressure in the striking cylinder 51 is not high enough to initiate the striking. Therefore, the present embodiment is safer for users than the prior art. In addition, in terms of power consumption, the present embodiment is rather efficient since the movement of the air valve 61 is driven by the safety component 42 without electric power involved.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electric nail gun comprising:

a machine body;

a muzzle unit that includes a muzzle seat connected to said machine body and adapted for loading a nail along an axis, and a safety component mounted movable to said muzzle seat, and having a contact portion adapted for making contact with a workpiece to initiate movement of said safety component relative to said muzzle seat along the axis;

a cylinder unit that is disposed in said machine body, and that includes a striking cylinder connected to said muzzle unit, defining a cylinder space that is elongated along the axis, and having an open end, at least one storage chamber connected to said striking cylinder, defining an internal space that is adapted for storing pressurized air, and having an open end, and a sealing cap coupled to said striking cylinder and said at least one storage chamber, said open ends of said striking cylinder and said at least one storage chamber cooperating with said sealing cap to define an air space that is in spatial communication with said cylinder space and said internal space;

a valve unit that includes an air valve disposed in said air space of said cylinder unit, and being directly and solely movable by said safety component along the axis from a closed position, where said air valve is coupled to said open end of said striking cylinder to prohibit the pressurized air stored in said air space from flowing into said cylinder space, to an open position, where said air valve is disposed away from said open end of said striking cylinder to allow the pressurized air stored in said air space to flow into said cylinder space; and a nail-striking unit that includes a piston movably disposed in said cylinder space of said striking cylinder, and a striking member connected co-movably to said piston, sand extending along the axis into said muzzle seat;

wherein, when said air valve is at the open position, said piston is urged by the pressurized air flowing into said cylinder space to move along the axis, thereby moving said striking member to strike the nail.

2. The electric nail gun as claimed in claim 1, wherein said valve unit further includes a connecting component mounted to said striking cylinder and movable relative to said striking cylinder along the axis, said connecting component interconnecting said air valve and said safety component when said air valve moves from the closed position to the open position.

3. The electric nail gun as claimed in claim 2, wherein said connecting component includes two guide rods that are mounted to said striking cylinder and that are movable relative to said striking cylinder, said air valve being connecting co-movably to said connecting component.

4. The electric nail gun as claimed in claim 3, wherein:

said guide rods of said connecting components are spaced apart from each other and extend in a direction of the axis; and said connecting component further includes a curved portion that extends circumferentially along an outer surface of said striking cylinder, that has opposite end portions connected respectively to said guide rods, and that is in contact with said safety component when said air valve moves from the closed position to the open position.

5. The electric nail gun as claimed in claim 2, wherein said muzzle unit further includes a resilient member mounted between said muzzle seat and said safety component for biasing said safety component away from said valve unit along the axis.

6. The electric nail gun as claimed in claim 1, wherein:

said air valve of said valve unit has opposite outer and inner surfaces facing respectively said air space and said cylinder space when said air valve is at the closed position, and at least one air-releasing hole extending through said inner and outer surfaces;

said valve unit further includes at least one unidirectional valve mounted to said air valve, and openably sealing said at least one air-releasing hold; and when said air valve is at the closed position, movement of said piston toward said air valve pressurizes air in said cylinder space, such that the pressurized air opens said at least one unidirectional valve to flow into said air space via said at least one air-releasing hole.

7. The electric nail gun as claimed in claim 6, wherein:

said at least one air-releasing hole includes a plurality of air-releasing holes that are arranged angularly around said air valve;

said at least one unidirectional valve includes one unidirectional valve, said unidirectional valve being configured as an O-ring, and surrounding said air valve such that said unidirectional valve openably seals said air-releasing holes; and when said air valve is at the closed position, and when said piston moves toward said air valve, said unidirectional valve is pushed by the air flowing from said cylinder space into said air-releasing holes to unseal said air-releasing holes.

8. The electric nail fun as claimed in claim 1, wherein said nail-striking unit further includes:

a cogged portion co-movably connected to said piston, and extending in the direction of the axis; and a lifting gear rotatably mounted too said muzzle seat, disengageably engaging said cogged portion, and being rotatable by electric power to move said cogged portion and said piston along the axis toward said air valve.

9. The electric nail gun as claimed in claim 8, wherein:

the rotation of said lifting gear is unidirectional; and a periphery of said lifting gear is formed with a toothed section and an untoothed section such that said cogged portion is moved by said lifting gear toward said air valve when said toothed section engages said cogged portion, and that said cogged portion is not driven by said lifting gear when said toothed section disengages said cogged portion and when said untoothed section is adjacent to said cogged portion.

* * * * *